US005823890A

United States Patent [19]

Maruko et al.

[11] Patent Number: 5,823,890

[45] Date of Patent: Oct. 20, 1998

[54] GOLF BALL

[75] Inventors: Takashi Maruko; Shinichi Kakiuchi; Junji Umezawa, all of Chichibu, Japan

[73] Assignee: Bridgestone Sports Co., Ltd., Tokyo, Japan

[21] Appl. No.: 797,943

[22] Filed: Feb. 12, 1997

[30] Foreign Application Priority Data

Feb. 16, 1996 [JP] Japan ..... 8-053918

[51] Int. Cl.[6] ..... A63B 37/12

[52] U.S. Cl. ..... 473/354; 473/359; 473/365; 473/373; 473/374; 473/378

[58] Field of Search ..... 473/354, 359, 473/365, 373, 374, 378

[56] References Cited

U.S. PATENT DOCUMENTS 5,048,838 9/1991 Chikaraishi et al. ..... 473/373 X

*Primary Examiner*—George J. Marlo
*Attorney, Agent, or Firm*—Sughrue, Mion, Zinn, Macpeak & Seas, PLLC

[57] ABSTRACT

A golf ball is prepared by forming a cover of two layer structure consisting of an inner layer and a thin outer layer on a core by heat compression molding. A color difference ΔE in Lab color space between the inner and outer layers is up to 3. Tracks of seams and streaks on the inner layer at the parting line are visually unperceivable, and the ball is good looking.

9 Claims, 1 Drawing Sheet

GOLF BALL

BACKGROUND OF THE INVENTION

1. Field of the Invention

This invention generally relates to a golf ball comprising a core (solid core or wound core) and a cover. More particularly it relates to a golf ball of good appearance comprising a core and a cover of a two layer structure consisting of inner and outer layers formed on the core by heat compression molding.

2. Prior Art

In the golf ball manufacturing art, it is well known to enclose a core with a cover by preforming hemi-spherical half cups, enclosing a core with a pair of half cups, and heat compression molding the cups to the core. An alternative method is to injection mold a cover stock over a core.

For golf balls whose cover is a two layer structure consisting of a hard inner layer and a soft outer layer, the cover outer layer must be formed as thin as possible in order to improve or maintain the restitution of the ball. Where it is desired to reduce the gage of the cover outer layer to less than 1 mm, the injection molding method is not applicable and the heat compression molding method is often employed.

The heat compression molding method, however, has a parting line problem. A usual procedure involves mating a pair of half cups to encircle a core in a mold which can be separated into upper and lower mold parts and then effecting heat compression molding. Upon mold clamping, the cover stock can be forced out of the junction (or parting line) between the half cups to form fins. The fins are trimmed and the resultant burrs are polished or otherwise post-treated, obtaining a finished product. The above-mentioned manufacturing process cannot avoid tracks of some fine seams and streaks that are left at the parting line as a result of exudation of the cover stock.

The problem becomes serious in the cover of two layer structure consisting of inner and outer layers, particularly when a color difference exists between the inner and outer layers, more particularly when the inner layer has a higher lightness and a darker color than the outer layer. If such a cover is formed by a heat compression molding method, tracks of seams and streaks formed on the inner layer at the parting line are perceived prominent through the outer layer. Such a poor outer appearance reduces the commodity value of a completed ball.

SUMMARY OF THE INVENTION

Therefore, an object of the present invention is to provide a golf ball of quality which is improved in outer appearance in that when a cover of two layer structure consisting of inner and outer layers is formed over a core by heat compression molding, tracks of seams and streaks formed on the inner layer are not readily perceivable at the parting line.

In connection with a golf ball comprising a core and a cover of two layer structure consisting of inner and outer layers, we have found that by optimizing a color difference between the inner and outer layers of the cover, more specifically by setting a color difference ΔE of 3 or less in Lab color space between the inner and outer layers of the cover, tracks of seams and streaks formed on the inner layer are not readily perceivable to the naked eye at the parting line of the ball (outer layer) where a soft thin outer layer is formed on a hard thick inner layer by heat compression molding or where a thin outer layer itself is utilized as an outer coating. There is obtained a golf ball which is improved in outer appearance, that is, a golf ball of quality.

According to the invention, there is provided a golf ball comprising a core and a cover of two layer structure consisting of inner and outer layers, wherein a color difference ΔE in Lab color space between the inner and outer layers is up to 3 as measured by a calorimeter.

DESCRIPTION OF THE PREFERRED EMBODIMENTS

Figure 1:
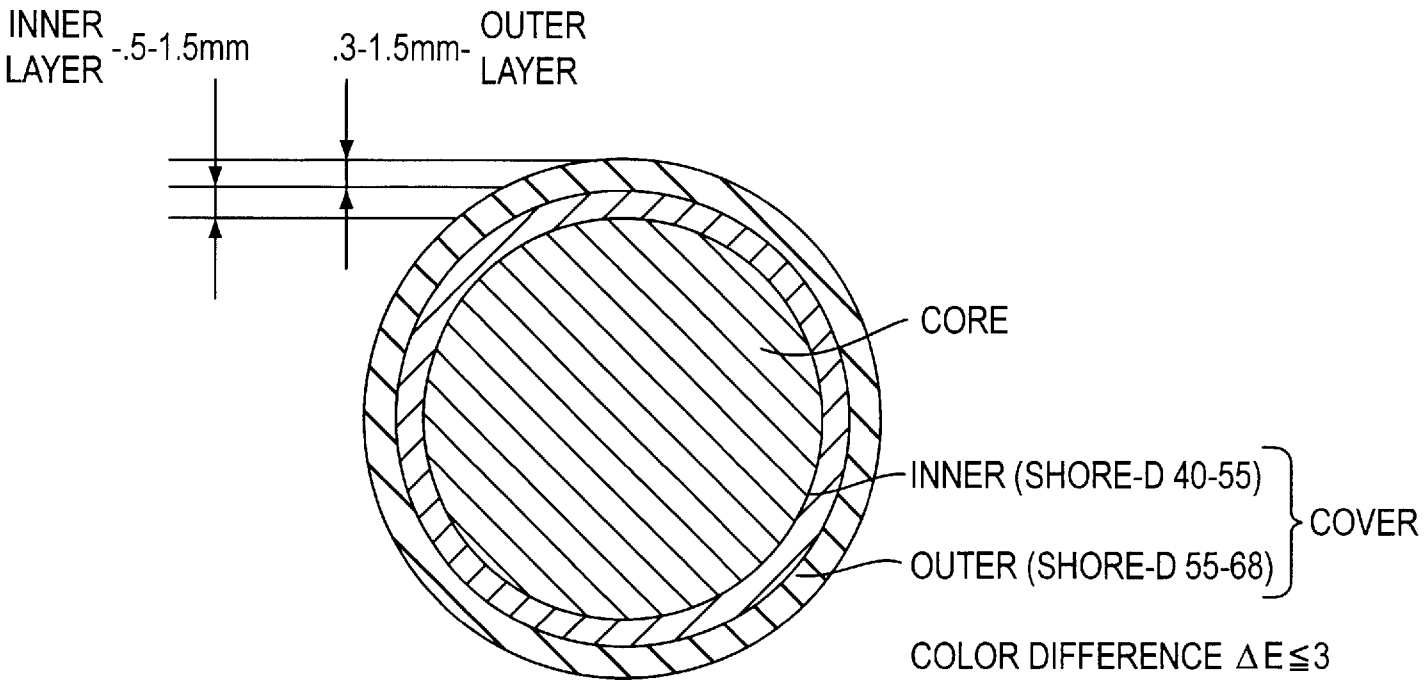
FIG. 1, the only FIGURE, illustrates the invention.

In a golf ball comprising a core and a cover of two layer structure consisting of inner and outer layers as illustrated in, the invention optimizes a color difference ΔE in Lab color space between the inner and outer layers. Then, even when the cover is formed on the core by heat compression molding, the parting line is free from appearance defects including tracks of seams and streaks perceivable to the naked eyes.

It is noted that the Lab color space is expressed by the following equations using tristimulus values X, Y and Z as prescribed in JIS Z8701.

$$L=10Y^{1/2} \tag{1}$$

$$a=17.5(1.02X-Y)/Y^{1/2} \tag{2}$$

$$b=7.0(Y-0.847Z)/Y^{1/2} \tag{3}$$

In the equations, X, Y and Z are tristimulus values in a XYZ system on a perfect diffuse reflection surface.

In the Lab color space, L stands for a lightness which represents whether a perceived color is light or dark, that is, a degree of brightness. Larger values of L indicate brighter color. From the standpoint of the outer appearance of a ball (that is, the standpoint of increasing the commodity value), the value of L is preferably at least 90, especially at least 92. Letters a and b represent color in the red-green direction and yellow-blue direction, respectively. Larger values of a indicate more reddish color whereas smaller values of a indicate more greenish dolor. Larger values of b indicate more yellowish color whereas smaller values of b indicate more bluish color. The inner and outer layers of the cover of the golf ball according to the invention have a value of a in the range between −3 and 3 and a value of b in the range between −15 and −5. In particular, a value of b in this range offers an additional advantage that when soil or grass juice attaches to the ball, stain appears less prominent.

In the present invention, the inner and outer layers of the cover are measured for Lab color difference by a Hunter's color difference gloss meter (known as Hunter's Lab color difference), from which a color difference ΔE therebetween is calculated. Specifically, a color difference ΔE between the inner and outer layers is determined by measuring the Hunter's Lab color difference (L1, a1, b1) of the outer layer and the Hunter's Lab color difference (L2, a2, b2) of the inner layer, calculating the differences ΔL=L1−L2, Δa=a1−a2, and Δb=b1−b2, and calculating the color difference ΔE according to the following equation (4).

$$\Delta E=(\Delta L^2+\Delta a^2+\Delta b^2)^{1/2} \tag{4}$$

According to the invention, the color difference ΔE between the inner and outer layers of the cover should be up to 3, preferably in the range of 0 to 1.5. With a color difference ΔE within the range of 0.1 to 1.5, the two layers cannot be discriminated by visual observation. A color difference ΔE of more than 3 means that the inner and outer layers of the cover are so different in color that tracks of seams and streaks on the inner layer appear prominent at the parting line of a completed product. That is, the product has outer appearance defects.

In the practice of the invention, the core is preferably enclosed with the cover by heat compression molding partly because the outer layer must be as thin as possible to improve restitution. The heat compression molding method used herein may be carried out by well-known means which are commonly used to form the cover in the manufacture of conventional golf balls. In a typical procedure, a pair of hemi-spherical half cups are previously formed from a cover stock, a core is enclosed with the pair of half cups, and the entirety is heat compression molded at a temperature of about 130° to 160° C. and a pressure of about 100 to 200 $kg/cm^2$ for about 3 to 10 minutes.

In one preferred embodiment of the invention, the outer layer of the cover is thinner than the inner layer because the ball is then improved in restitution. Typically the inner layer has a gage of 0.5 to 1.5 mm, especially 0.8 to 1.2 mm, and the outer layer has a gage of 0.3 to 1.5 mm, especially 0.5 to 1.0 mm.

In a further preferred embodiment of the invention, the outer layer is formed of a resin composition having a Shore D hardness of 40 to 55, especially 45 to 52, and the inner layer is formed of a resin composition having a Shore D hardness of 55 to 68, especially 60 to 65. It is further preferred for ease of ball control that the outer layer is softer than the inner layer. The difference in hardness between the inner layer resin and the outer layer resin is at least 5, especially at least 8, as expressed in Shore D hardness.

It is acceptable in the practice of the invention to form a paint coating on the outer layer of the cover.

The cover stocks of which the inner and outer layers are formed may be selected from conventional materials known to exhibit good performance as a golf ball cover. A choice may be made among, for example, ionomer resins, polyester elastomers, and thermoplastic polyurethane elastomers alone or in admixture with polyamide resins and ethylene-vinyl acetate copolymers. An ionomer resin base stock is preferred while a mixture of two or more ionomer resins may be used. If desired, titanium oxide, barium sulfate, dispersants and pigments may be blended in the cover stock. By adjusting the amounts of these additives blended, the cover may be controlled optimum in terms of Lab color space. It is noted that magnesium stearate is typical of the dispersant and bluing agents such as ultramarine are useful pigments. The cover stock is prepared by thoroughly kneading the components by a well-known milling method and formed into a pair of hemi-spherical half cups to be subject to heat compression molding.

The golf ball of the invention requires optimization of a color difference ΔE in Lab color space between the inner and outer layers of the cover while the core to be enclosed with the cover is not critical. The ball may be either a wound golf ball using a wound core or a solid golf ball using a solid core. The wound core and solid core used herein may be the same as conventional wound cores and solid cores. Cores formed from well-known materials by conventional methods may be used. The weight, diameter and hardness of the wound or solid core may be properly adjusted insofar as the objects of the invention are attained.

While the golf ball of the invention is constructed as mentioned above, the diameter, weight and other parameters of the ball may be properly selected in accordance with the Rules of Golf.

There has been described a golf ball of quality which is improved in outer appearance in that when a cover of two layer structure consisting of inner and outer layers is formed over a core by heat compression molding, tracks of seams and streaks on the inner layer are not readily perceivable to the naked eye at the parting line. Better results are obtained when the outer layer is formed thin and soft enough to play the role of an outer coating.

EXAMPLE

Examples of the present invention are given below by way of illustration and not by way of limitation. All parts are by weight.

Examples 1–3 & Comparative Examples 1–3

Thread wound golf balls were prepared.

A solid center having an outer diameter of 32 mm was first prepared by kneading a rubber composition of the formulation shown below and molding and vulcanizing the composition at 150° C. for 15 minutes.

| Center-forming rubber composition | Parts by weight |
|---|---|
| Cis-1,4-polybutadiene | 100 |
| Zinc acrylate | 22 |
| Zinc oxide | 30 |
| Barium sulfate | 35 |
| Dicumyl peroxide | 1.2 |

Thread rubber was conventionally wound on the center to form a thread rubber layer of about 6 mm thick.

A pair of hemi-spherical half cups were formed from each of cover inner layer-forming compositions A to F shown in Table 1. Another pair of hemi-spherical half cups were formed from a common cover outer layer-forming composition shown below. The half cups for the inner layer had a gage of 1.2 mm and a Shore D hardness of 64, and the half cups for the outer layer had a gage of 1.2 mm and a Shore D hardness of 51.

TABLE 1

| | Cover inner layer composition | | | | | |
|---|---|---|---|---|---|---|
| | A | B | C | D | E | F |
| Himilan 1605 (Na) | 50 | 50 | 50 | 50 | 50 | 50 |
| Himilan 1706 (Zn) | 50 | 50 | 50 | 50 | 50 | 50 |
| Titanium oxide | 2 | 2 | 5 | 5 | 5 | 2 |
| Barium sulfate | 3 | 3 | 0 | 0 | 0 | 3 |
| Dispersant | 1 | 1 | 1 | 1 | 1 | 1 |
| Bluing agent | 0.01 | 0.02 | 0.03 | 0 | 0.1 | 0.05 |

| Cover outer layer composition | Parts by weight |
|---|---|
| Himilan 1557 (Zn) | 25 |
| Surlyn 8120 (Na) | 50 |
| Himilan 1856 (Na) | 25 |
| Titanium oxide | 2 |
| Barium sulfate | 1 |
| Dispersant | 1 |
| Bluing agent | 0.01 |

Note that Himilan is a trade mark of an ionomer resin manufactured by Mitsui-duPont Poly-Chemical K. K. and Surlyn is a trade mark of an ionomer resin manufactured by E. I. duPont.

A color difference ΔE between the inner and outer layers was determined by measuring the Lab color difference (L1, a1, b1) of the outer layer half cups and the Lab color difference (L2, a2, b2) of the inner layer half cups by means of a multiple light source spectral calorimeter model MSC-IS-2DH (manufactured by Suga Tester K. K.), calculating the differences ΔL, Δa, and Δb, and calculating the color difference ΔE according to equation (4). The results are shown in Table 2.

The wound core was enclosed with a pair of inner layer half cups and a pair of outer layer half cups, placed in a mold, and heat compression molded at 140° C. and 130 kg/cm$^2$ for 5 minutes. Post-treatment including trimming and deburring yielded golf balls of Examples 1–3 and Comparative Examples 1–3.

The golf balls were visually examined for outer appearance and evaluated according to the following criterion. The results are shown in Table 2.

Rating

O: tracks of seams and streaks on the inner layer are unperceivable at the parting line Δ: tracks of seams and streaks on the inner layer are perceivable at the parting line when the ball is grasped with the hand X: tracks of seams and streaks on the inner layer are perceivable at the parting line from a distance of 2 or 3 meters.

TABLE 2

| | | E1 | E2 | E3 | CE1 | CE2 | CE3 |
|---|---|---|---|---|---|---|---|
| Cover outer layer | L1 | 94.5 | 94.5 | 94.5 | 94.5 | 94.5 | 94.5 |
| | a1 | −1.4 | −1.4 | −1.4 | −1.4 | −1.4 | −1.4 |
| | b1 | −4.1 | −4.1 | −4.1 | −4.1 | −4.1 | −4.1 |
| Cover inner layer | Composition | A | B | C | D | E | F |
| | L2 | 94.4 | 94.8 | 94.6 | 98.3 | 86.9 | 92.5 |
| | a2 | −1.4 | −0.9 | −0.3 | −0.8 | 0.2 | −0.5 |
| | b2 | −3.8 | −3.9 | −4.9 | 2.2 | −15.2 | −7.0 |
| Difference | ΔL | 0.1 | −0.3 | −0.1 | −3.8 | 7.6 | 2.0 |
| | Δa | 0.0 | −0.5 | −1.1 | −0.6 | −1.6 | −0.9 |
| | Δb | −0.3 | −0.2 | 0.8 | −6.3 | 11.1 | 2.9 |
| | ΔE | 0.3 | 0.6 | 1.4 | 7.4 | 13.5 | 3.6 |
| Outer appearance | | ○ | ○ | ○ | x | x | Δ |

It is evident from Table 2 that the golf balls of Comparative Examples 1 and 2 wherein the color difference ΔE in Lab color space between the inner and outer layers of the cover was as large as 7.4 and 13.5 had poor appearance since tracks of seams and streaks on the inner layer at the parting line appeared prominent and were perceivable to the naked eyes even at a distance of 2 or 3 meters. The ball of Comparative Example 3 wherein the color difference ΔE had a somewhat large value of 3.6 was also unacceptable in appearance since tracks of seams and streaks on the inner layer at the parting line were perceivable to the naked eyes at an arms distance.

In contrast, the golf balls of Examples 1 to 3 wherein the color difference ΔE between the inner and outer layers of the cover was less than 3 were improved in outer appearance because tracks of seams and streaks on the inner layer at the parting line were unperceivable.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a core and a cover of two layer structure consisting of inner and outer layers, wherein a color difference ΔE in Lab color space between the inner and outer layers is up to 3 as measured by a calorimeter.

2. The golf ball of claim 1 wherein the cover is formed on the core by heat compression molding.

3. The golf ball of claim 1 wherein the outer layer of the cover has a gage of 0.3 to 1.5 mm, the inner layer has a gage of 0.5 to 1.5 mm, and the inner layer has a higher hardness than the outer layer.

4. The golf ball of claim 1 wherein the outer layer of the cover is formed of a resin composition having a Shore D hardness of 40 to 55, the inner layer is formed of a resin composition having a Shore D hardness of 55 to 68, the inner layer resin composition is harder than the outer layer resin composition by a Shore D hardness of at least 5.

5. The golf ball of claim 1 wherein said inner layer has a gage in the range of 0.8 to 1.2 mm.

6. The golf ball of claim 1 wherein said outer layer has a gage in the range of 0.5 to 1.0 mm.

7. The golf ball of claim 1 wherein said outer layer has a Shore D hardness in the range of 45 to 52.

8. The golf ball of claim 1 wherein said inner layer has a Shore D hardness in the range of 60 to 65.

9. The golf ball of claim 1 wherein said inner layer is harder than said outer layer by a Shore D hardness of at least 8.

* * * * *